US005083668A

United States Patent [19]

Bushey

[11] Patent Number: 5,083,668

[45] Date of Patent: Jan. 28, 1992

[54] POINT-OF-PURCHASE DISPLAYS

[76] Inventor: Richard D. Bushey, 3521 16th Ave., Kenosha, Wis. 53140

[21] Appl. No.: 572,506

[22] Filed: Aug. 24, 1990

[51] Int. Cl.[5] ..... A47F 5/00

[52] U.S. Cl. ..... 211/59.1; 211/87; 248/220.3; 160/135

[58] Field of Search ..... 211/57.1, 59.1, 87, 211/189; 248/220.2, 220.3, 220.4, 221.1; 160/135; 52/36

[56] References Cited

U.S. PATENT DOCUMENTS

| | | | |
|---|---|---|---|
| 3,172,540 | 3/1965 | Berge | 211/87 |
| 4,671,417 | 6/1987 | O'Brien | 211/59.1 |
| 4,696,407 | 9/1987 | Franklin | 248/220.3 X |
| 4,805,783 | 2/1989 | Mayer | 211/189 X |
| 4,830,080 | 5/1989 | Densen | 160/135 |
| 4,860,905 | 8/1989 | Schott et al. | 211/59.1 |

FOREIGN PATENT DOCUMENTS

| | | | |
|---|---|---|---|
| 2026850 | 2/1980 | United Kingdom | 248/220.4 |

*Primary Examiner*—Robert W. Gibson, Jr.
*Attorney, Agent, or Firm*—John C. Shepard

[57] ABSTRACT

A point-of-purchase display includes adjacent aligned panels having horizontal corrugations and spaced X-shaped slits cut therethrough, hangers for supporting product extending through the panel slits, U-shaped elongate clips adapted to frictionally engage the lateral edge of a panel to hold panels in vertical alignment, and side rails having a guard and a free end extending horizontally through clip apertures into the corrugations. The panels may be hinged together and friction means may be placed on the side rail ends to limit free movement within the corrugations.

14 Claims, 3 Drawing Sheets

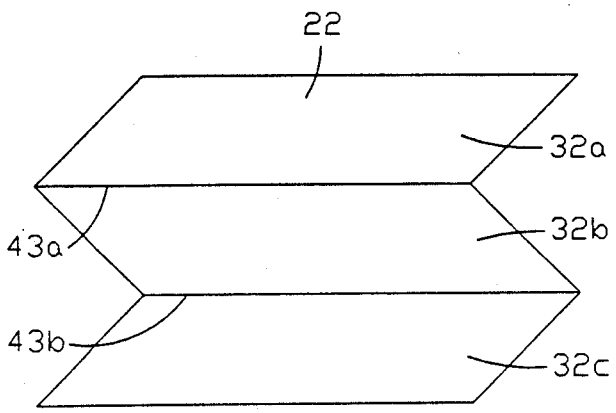
FIG. 2
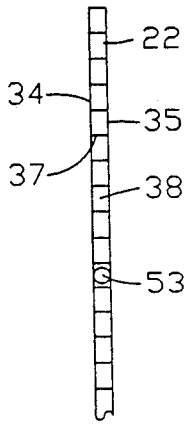
FIG. 5
FIG. 6
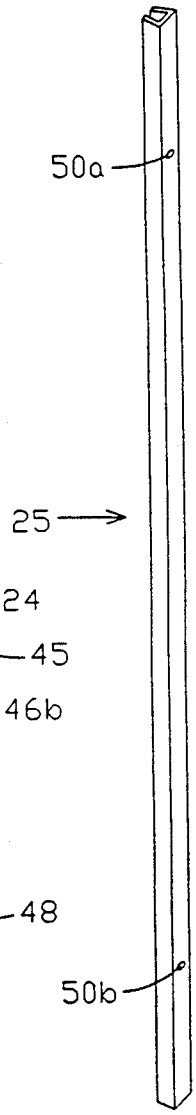
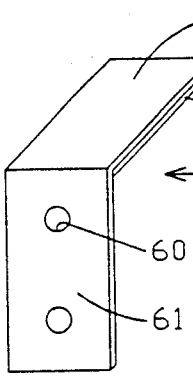
FIG. 3
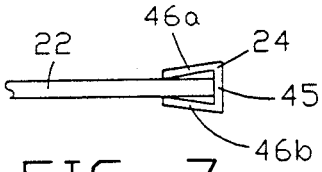
FIG. 7
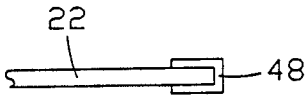
FIG. 8
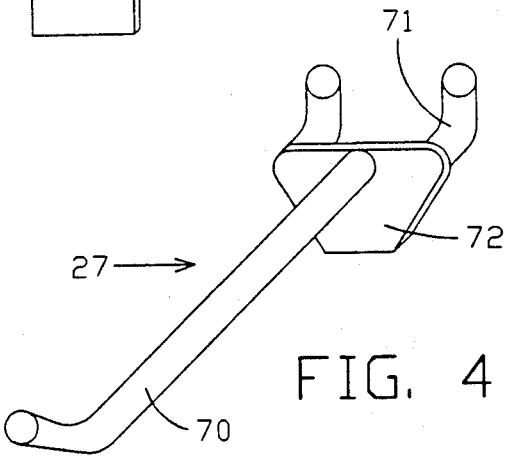
FIG. 4

POINT-OF-PURCHASE DISPLAYS

BACKGROUND OF THE INVENTION

1. Technical Field

This invention relates generally to displays and, more particularly, to point-of-purchase displays.

2. Background Art

In the prior art, point-of-purchase displays for storing product and promoting its sale are quite common. One type often utilized includes masonite pegboard formed with uniformly spaced holes which are drilled or punched through the material. Metal hangers are inserted into the pegboard holes and product is hung from the forward extending hangers. The pegboard is usually constructed from a single piece of material and is relatively heavy. Corrugated cardboard has been employed as a lightweight, but temporary, substitute for displays of this type. Slat wall displays constructed of wood or similar materials with linear recesses can be permanently constructed as store fixtures. Special brackets and hangers are mounted in the recesses of these slat wall displays to hold product.

It would be highly desirable to provide a display of the point-of-purchase type that occupies a small amount of space during shipping, is relatively light, is strong enough to support heavier goods for a longer period of time, and does not have drilled or punched holes that blemish the surface appearance of the display.

SUMMARY OF THE INVENTION

The present invention is directed to overcoming one or more of the problems as set forth above.

According to the present invention, a point-of-purchase display includes adjacent aligned panels having horizontal corrugations and spaced slits cut therethrough, hangers for supporting product extending through the panel slits, U-shaped elongate clips adapted to frictionally engage the lateral edge of a panel to hold panels in vertical alignment, and side rails having a guard portion and a free end extending horizontally through clip apertures into the corrugations.

In a exemplary embodiment of the invention, the slits are X-shaped and formed from thin intersecting cuts extending through the panel thickness.

In another exemplary embodiment of the invention, separate clips join each pair of adjacent panels permitting the components to be made relatively small.

In a further other exemplary embodiment of the invention, the panels are joined by a "living" hinge so that the separate panels may be folded between flat and closed positions.

Gripping means may be placed on the side rail ends to limit free movement within the corrugations.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 2 is a reduced, perspective view of the display board of FIG. 1 showing the three panel sections in a partially folded position;

FIG. 3 is an enlarged perspective view of one of the mounting brackets;

FIG. 4 is an enlarged perspective view of one of the hangers;

FIG. 5 is an enlarged, partial side elevational view of the corrugated display board panel;

FIG. 6 is an enlarged, perspective view of one of the supporting clips;

FIG. 7 is an enlarged, partial top elevational view of the corrugated display board panel with the supporting clip attached;

FIG. 8 is an enlarged, partial top elevational view of the corrugated display board panel with a second embodiment of the supporting clip attached;

DESCRIPTION OF THE PREFERRED EMBODIMENTS

Best Modes for Carrying Out the Invention

Figure 1:
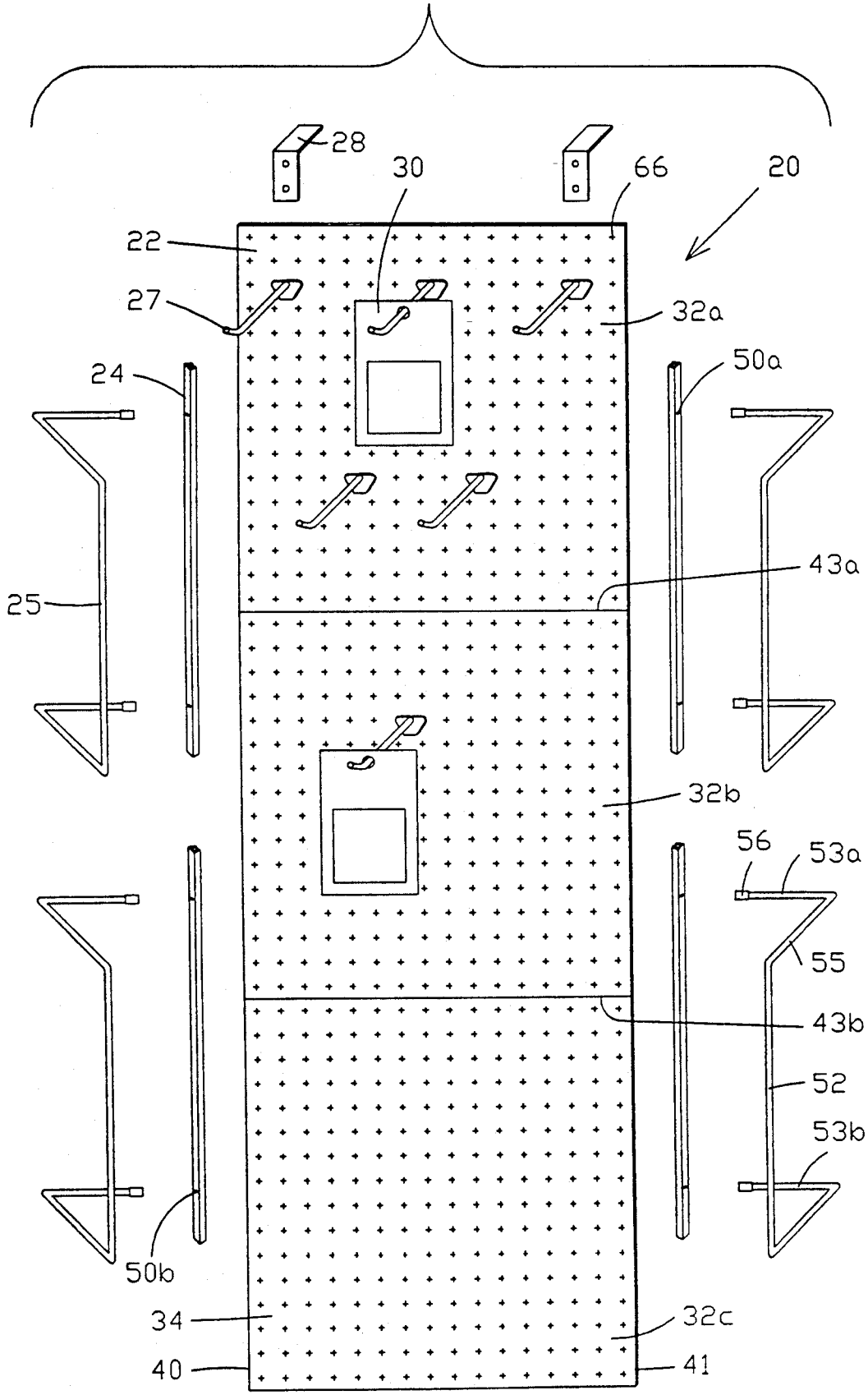
FIG. 1 is an exploded, perspective view of a display constructed in accordance with the present invention.
Figure 9:
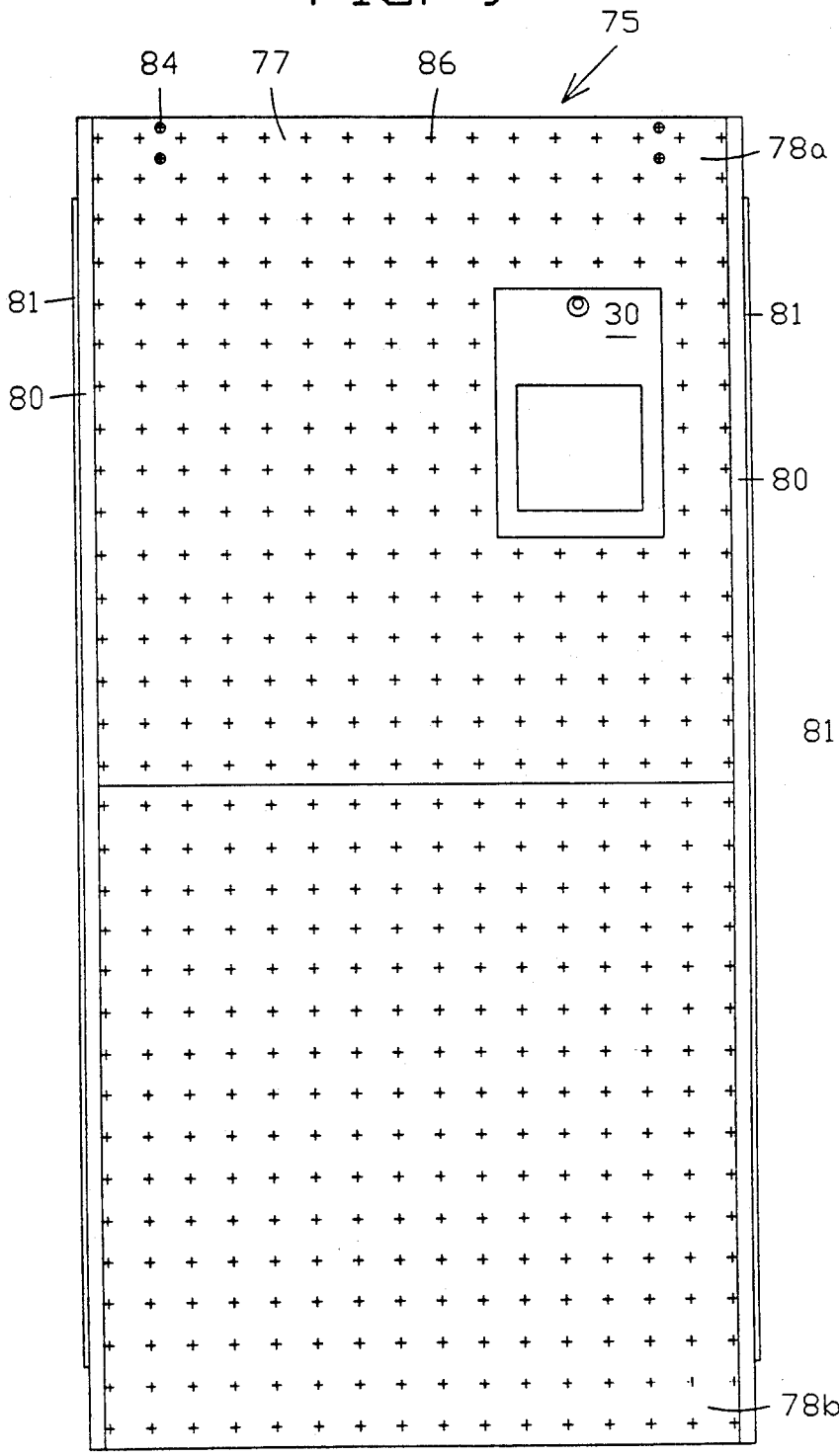
FIG. 9 is a front view of a second embodiment of the display.

Referring to FIG. 1 of the drawings, a display, generally designated 20, is seen to include a corrugated display board 22, trim pieces or edge clips 24, side rails 25, hangers 27, and mounting brackets 28. The hangers 27 carry product, such as blister packages 30, which are displayed forward of the display board 22. In FIGS. 8 and 9, similar elements shown in assembled relation comprise another display, generally designated 75.

The display board 22 may be comprised of one or more panel sections, designated 32*a*, 32*b* and 32*c*, formed from corrugated thermoplastic material, such as polypropylene. The display board 22 of FIG. 1 is comprised of three vertically aligned panels 32, while the display board 77 in FIG. 8 is comprised of two panels 78*a* and 78*b*. The display board 22 includes a front web 34 and a back web 35 joined by a series of internal ribs or walls 37 to define a vertical series of tubes 38 that extend horizontally across the display between the lateral edges 40 and 41 thereof. Herein, the panel sections 32 are approximately ⅛ inch thick. The tubes 38 may have rectangular, square, or other suitable cross sections. "Living" hinges 43*a* and 43*b* may be defined between the panel sections 32*a*, 32*b* and 32*c* by horizontally cutting, fluting, or scoring the corrugated material so that the linked panel sections 32 may be folded between open and flat positions as seen in FIG. 2. Alternatively, the board may be constructed from separate panel sections.

When the panel sections 32 are unfolded and placed end-to-end into vertical alignment, the elongate supporting clips 24 are placed onto the lateral edges 40 and 41 to prevent the panel sections 32 from moving or separating. As seen in FIGS. 5 through 7, each clip 24 has a U-shaped cross-section with a center portion 45 joining opposed leg portions 46*a* and 46*b*. The clip 24 is adapted to frictionally engage a lateral edge 40 or 41 of the panel sections 32 so that the panel sections 32 are frictionally engaged and clamped between the resilient legs 46*a* and 46*b* thereof. In FIG. 7, the channel defined by the legs 46*a* and 46*b* of the clip 24 narrows at its opening because of the legs 46*a* and 46*b* are angled slightly inward. In FIG. 8, the channel of the clip 48 is uniform so that the legs are in substantially parallel relation when the clip 48 is attached to the display board.

The clips 24 also have a pair of apertures 50*a* and 50*b* defined through the center portion 45 adapted to receive the side rails 25 as described below.

The side rails 25 are made from rods which are bent as shown in FIG. 1. The side rails 25 have a U-shaped guard portion 52 and a pair of free end portions 53*a* and 53*b* extending from each leg 55 of the guard portion 52. The end portions 53 of the side rails 25 are inserted horizontally through the apertures 50 defined in the center wall 45 of the clips 24 and into the horizontal corrugations or tubes 38 defined by the panel sections 32. The guard portion 52 extends forward from the front web 34 to shield the hangers 27 and the product 30 from being disturbed by accident. The ends 56 of the side rails 25 may be coated with high-friction material, such as rubber or glue, or enlarged to provide a friction fit. This treatment of the ends 56 provides a means to grip the interior of the corrugated tubes 38 and limit free movement of the side rails 25 within the tubes 38. Alternatively, the side rails can be constructed with material having a diameter slightly larger than the corrugated tubes so that even unmodified rail ends are still force fit into the panels. Note that side rails 25 also prevent removal of the clips 24 from the panel edges 40 and 41 until the side rails are themselves are removed.

Each of the L-shaped mounting brackets 27 may be optionally attached to the rear of the top panel section 32*a* by suitable means, such as screws 84, extending into the apertures contacting portion 61 as shown in FIG. 9. The extending portion 63 of the mounting bracket 28 may be secured to a shelf or other surface by suitable means or by the adhesive 64 provided on the bottom surface thereof.

The panel sections 32 have a rectangular array of openings 66 defined through the front and back webs 34 and 35 by thin X-shaped slits uniformly spaced on one-inch centers. The slits 66 are approximately ¼ inch across to accommodate the hangers which have approximately ⅛ inch diameter components. Slits 66 are made by making intersecting cuts. Eliminating drilled or punched holes maintains the surface appearance of the display 20 and eliminates the waste created by hole punches. Further, the thin cuts require less pressure to form than holes that might be punched through the panel.

As seen in FIG. 4, each hanger 27, which is of conventional design includes a product-carrying hook portion 70 and a pair of mounting hook portions 71, which are spaced on one-inch centers and are approximately ⅛ inch in diameter. To mount a hanger 27 on the front of the display 20, the mounting hooks 71 are pushed through a pair of thin openings 66. When the hanger 27 is pushed through the X-shaped slits, the material bent or deflected from the center of the opening 66 resiliently engages the outer surface of the hook portions 71 and tends to hold the hanger 27 tightly therein. The base 72 of the hanger 27 will rest against the front web 34 and the product-carrying hook 70 will extend forward from the display. Thereafter, packages 30 may be hung from the hanger 27 as seen in FIG. 1. Other types and shapes of hangers having suitably spaced mounting hooks may also be used. The hangers may be made of plastic, metal rod, or other suitable materials.

Figure 10:
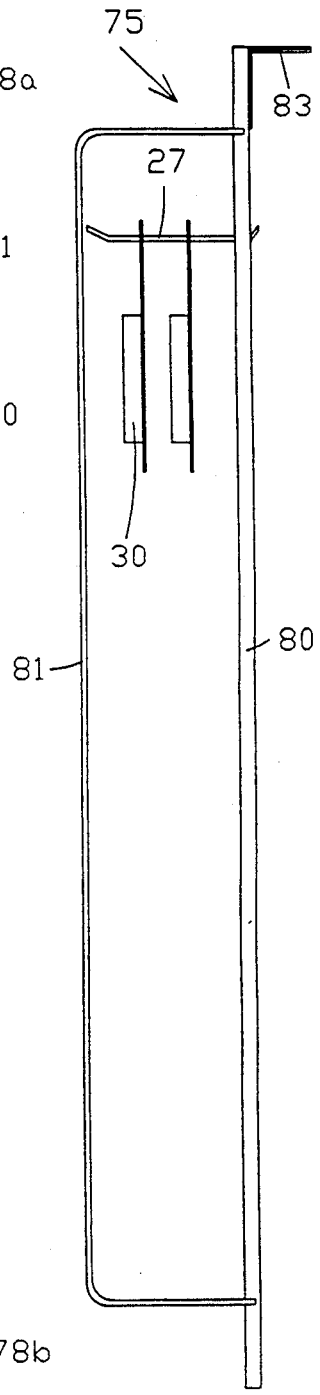
FIG. 10 is a side elevational view of the display shown in 9.

In FIGS. 9 and 10, a completely assembled display 75 includes a corrugated display board 77 comprised of top and bottom display panels 78*a* and 78*b*, U-shaped edge clips 80, U-shaped side guard rails 81 inserted through the clips into the panel corrugations, hangers 27, and mounting brackets 83 secured to the top panel by screws 84. The hangers 27 are inserted into spaced slits 85 and carry as blister packages 30, which are displayed forward of the display board 75.

Industrial Applicability

From the foregoing, it should be apparent that the displays described herein are simple and inexpensive and provide a convenient and effective means for displays goods and products for sale.

Other aspects, objects and advantages of this invention can be obtained from a study of the drawings, the disclosure and the appended claims.

What is claimed is:

1. A point-of-purchase display comprising:

a corrugated panel having front and back webs and internal ribs defining a series of horizontal tubes extending between the lateral edges thereof, an array of spaced slits cut through said webs;

at least one hanger having a product-carrying portion adapted to support product forward of said panel and a mounting portion extending through said slit;

a pair of U-shaped elongate clips, each having a center portion joining opposed leg portions, each clip adapted to frictionally engage a lateral edge of the panel between said leg portions and having at least one aperture defined in said center portion; and, a pair of side rails, each having a guard portion extending forward from said front web and a free end portion extending horizontally through a respective clip aperture into said corrugated tubes.

2. The display of claim 1 wherein said display includes two or more adjacent vertically aligned panels, said clips extending between said adjacent panels to hold the panels in alignment.

3. The display of claim 2 further including hinge means joining said adjacent panels together so that the panels may be folded between open and closed positions.

4. The display of claim 2 wherein said display has three or more adjacent vertically aligned panels and a separate clip extends between each pair of adjacent panels.

5. The display of claim 2 wherein one of said clips extends substantially over the entire length of adjacent lateral edges of said aligned panels.

6. The display of claim 1 wherein the clips extend substantially over the entire length of the panel lateral edge.

7. The display of claim 1 further including gripping means on the free ends of said side rails for limiting free movement of the side rails within said corrugated tubes.

8. The display of claim 1 wherein two apertures are defined in each clip and said side rail has a U-shaped guard portion and two free ends portions, one free end extending laterally from the each leg of said guard portion through respective clip apertures into said corrugated tubes.

9. The display of claim 1 wherein a slit is defined by intersecting cuts extending through the thickness of said panels.

10. The display of claim 1 wherein said panel is formed from plastic.

11. The display of claim 1 further including a mounting bracket secured to said panel and being adapted to attach said display to a supporting surface.

12. A point-of-purchase display comprising:

a corrugated plastic panel having front and back webs and internal ribs defining a series of horizontal tubes extending between the lateral edges thereof, an array of spaced slits cut through said webs, each of said slits being defined by intersecting thin cuts extending through the thickness of said panels; and, at least one hanger having a product-carrying portion adapted to support product forward of said panel and a mounting portion extending through said slit.

13. A point-of-purchase display comprising:

vertically aligned corrugated plastic panels each having front and back webs and internal ribs defining a series of horizontal tubes extending between the lateral edges thereof, each of said panels having an array of uniformly spaced of X-shaped slits cut through said webs;

hinge means joining adjacent panels together so that the panels may be folded between open and closed positions;

at least one hanger having a product-carrying portion adapted to support product forward of said panel and a mounting portion extending through said slit;

a pair of U-shaped elongate clips each having a center portion joining opposed legs portions and being adapted to frictionally engage the lateral edge of a panel between said leg portions and having a pair of apertures defined in said center portion, each clip extending between adjacent panels along respective lateral edges to hold the panels in alignment; and, a pair of side rails each having a U-shaped guard portion and a pair of free end portions extending laterally from each leg of said guard portion, said end portion extending horizontally through respective clip apertures into said corrugated tubes and said guard portion extending forward from said front web.

14. The display of claim 13 further including gripping means on the free ends of said side rails for limiting free movement of the side rails within said corrugated tubes.

* * * * *